US009865235B2

(12) United States Patent
Compton

(10) Patent No.: US 9,865,235 B2
(45) Date of Patent: Jan. 9, 2018

(54) MUSICAL INSTRUMENT

(76) Inventor: Brian Compton, San Diego, CA (US)

( * ) Notice: Subject to any disclaimer, the term of this patent is extended or adjusted under 35 U.S.C. 154(b) by 8 days.

(21) Appl. No.: 14/415,270

(22) PCT Filed: Jul. 17, 2012

(86) PCT No.: PCT/US2012/047032
§ 371 (c)(1),
(2), (4) Date: Jan. 16, 2015

(87) PCT Pub. No.: WO2014/014449
PCT Pub. Date: Jan. 23, 2014

(65) Prior Publication Data
US 2015/0187341 A1 Jul. 2, 2015

(51) Int. Cl.
*G10D 3/12* (2006.01)
*G10D 3/10* (2006.01)
*G10D 1/00* (2006.01)
*G10D 3/08* (2006.01)

(52) U.S. Cl.
CPC ..... *G10D 3/10* (2013.01); *G10D 1/00* (2013.01); *G10D 3/08* (2013.01)

(58) Field of Classification Search
CPC ..... G10D 3/10; G10D 1/00
USPC ..... 84/297 R, 317, 318
See application file for complete search history.

(56) References Cited

U.S. PATENT DOCUMENTS

| | | | | |
|---|---|---|---|---|
| 1,735,145 | A | 11/1929 | Taubert | |
| 4,222,303 | A | 9/1980 | Kryzanowsky | |
| 5,831,189 | A | 11/1998 | Edlund | |
| 6,958,439 | B1 * | 10/2005 | White | G10D 3/043 84/315 |
| 8,319,082 | B1 * | 11/2012 | Bacon | G10D 3/08 84/314 R |
| 2013/0186256 | A1 * | 7/2013 | Ryan | G10D 3/043 84/318 |

FOREIGN PATENT DOCUMENTS

KR 2003-0045758 6/2003

OTHER PUBLICATIONS

International Search Report for PCT/US2012/047032 dated Mar. 8, 2013.

* cited by examiner

*Primary Examiner* — Jianchun Qin
(74) *Attorney, Agent, or Firm* — Knobbe Martens Olson & Bear LLP

(57) ABSTRACT

A musical instrument including a vibrating member, such as a string, and a clamping mechanism. The clamping mechanism can include a first clamping member and a second clamping member. The first clamping member and the second clamping member can move between a first, undamped position to a second, clamped position. The clamping mechanism divides the vibrating member into a first portion and a second portion when the clamping mechanism is in the second, clamped position.

28 Claims, 6 Drawing Sheets

MUSICAL INSTRUMENT

CROSS REFERENCE TO RELATED APPLICATIONS

This application is a U.S. National Phase Application of PCT International Application Number PCT/US2012/047032, filed on Jul. 17, 2012, designating the United States of America and published in the English language.

BACKGROUND OF THE INVENTION

Field of the Invention

The present application relates to musical instruments and methods of playing musical instruments.

Description of the Related Art

A musical instrument functions by creating sound waves of a certain frequency. In some instruments, his is accomplished with the vibration of a string. In some instruments, the created frequency can be varied by causing a string having certain vibrational characteristics to vibrate. In some instruments, such as a piano, the vibrational characteristics of the string and the frequency of the sound wave created can be determined by the length of the string. In some instruments, such as a guitar, the vibrational characteristics of the string and the frequency of the sound waves created can be determined, in part, by applying pressure to the string so as to divide the string into a vibrating portion and a non-vibrating portion.

While a skilled musician is able to use his fingers to rapidly switch notes by applying pressure to different portions of a string or by depressing different keys, these movements require years of practice, and a musicians ability is ultimately physically limited by the size of their hand and fingers, flexibility, and other traits. In light of these limitations, new musical instruments are required to facilitate the ability of less experienced musicians, musicians whose physical characteristics or abilities impose restrictions to play a desired piece of music, and to overcome the inherent constraints of instruments such as the electric bass guitar for which the distances between notes is less than optimal for the human hand.

SUMMARY OF THE INVENTION

Some embodiments relate to a musical instrument. In some embodiments, the musical instrument can include, for example, a string having a first end and a second end, which string can be anchored at is first end and at its second end. In some embodiments, the musical instrument can further include, a clamping mechanism positioned between the first and second ends of the string. The clamping mechanism can include, for example, a first clamping member. In some embodiments, the musical instrument can further include, a control panel comprising a control member that is operatingly connected to the clamping mechanism, which control member can activate the clamping mechanism so as to divide the string into a first portion and a second portion.

In some embodiments, the clamping mechanism further includes a second clamping member, and in some embodiments, first clamping member can include a first camming surface. In some embodiments, the second clamping mechanism can include a second camming surface that interacts with the first camming surface of the first clamping mechanism to transfer force between the first clamping mechanism and the second clamping mechanism.

In some embodiments, the control panel further includes a plurality of control members operatingly connected to a plurality of clamping mechanisms. In some embodiments, the musical instrument further includes a neck and a body.

In some embodiments, the first end of the string can be, for example, anchored to the body of the musical instrument, and in some embodiments, the second end of the string can be anchored to the neck of the musical instrument. In some embodiments, the body can further include a pickup.

In some embodiments, the first portion of the string is configured for vibration. In some embodiments, the first portion of the string is configured for vibration over a pickup.

Some embodiments relate to a clamping mechanism for use with a musical instrument and configured to clamp onto a string to thereby change frequency of the music generating portion of the string. In some embodiments the clamping mechanism can include, for example, a first clamping member including a first clamping body, and a first camming surface, and a second clamping member including a second clamping body, and a second camming surface. In some embodiments, the first camming surface of the first clamping member interacts with the second camming surface of the second clamping member, such that a movement of the first clamping member is transmitted to the second clamping member.

In some embodiments, for example, the first clamping member can further include a first axle that allows the first clamping member to rotate about the first axle, and a first actuation lever. In some embodiments, for example, the second clamping member further includes a second axle that allows the second clamping member to rotate about the second axle, and a second actuation lever. In some embodiments, for example, the second actuation lever is connected to an expansion spring.

In some embodiments, for example, the expansion spring can be, for example, a linear spring, a rubber band, or any other tension creating member. In some embodiments, the expansion spring biases the second clamping member to a first position.

In some embodiments, the second clamping does not contact the string when the second clamping member is in its first position. In some embodiments, for example, the second clamping member biases the first clamping member to a first position when the second clamping member is in the first position. In some embodiments, the first clamping member does not contact the string when the first clamping member is in the first position, and the second clamping does not contact the string when the second clamping member is in the first position. In some embodiments, the first clamping member includes a first clamping pad. In some embodiments, the second clamping member includes a second clamping pad.

Some embodiments relate to a method of playing a musical instrument having a string having a first end and a second end, a first clamping mechanism configured to contact the string at a first point, a second clamping mechanism configured to contact the string at a second point, and a control panel comprising a control member that controls the operation of the clamping mechanism. In some embodiments, this method can include, for example, vibrating the string, depressing the first control member so that the first clamping mechanism contacts the string at the first point and thereby changes the natural frequency of the string, and depressing a second control member so that the second clamping mechanism contacts the string at the second point and thereby changes the natural frequency of the string.

The foregoing is a summary and thus contains, by necessity, simplifications, generalizations, and omissions of detail; consequently, those skilled in the art will appreciate that the summary is illustrative only and is not intended to be in any way limiting. Other aspects, features, and advantages of the devices and/or processes and/or other subject matter described herein will become apparent in the teaching set forth herein. The summary is provided to introduce a selection of concepts in a simplified form that are further described below in the detailed description. This summary is not intended to identify key features or essential features of the claimed subject matter, nor is it intended to be used as an aid in determining the scope of the claimed subject matter

DETAILED DESCRIPTION OF THE PREFERRED EMBODIMENT

Figure 1:
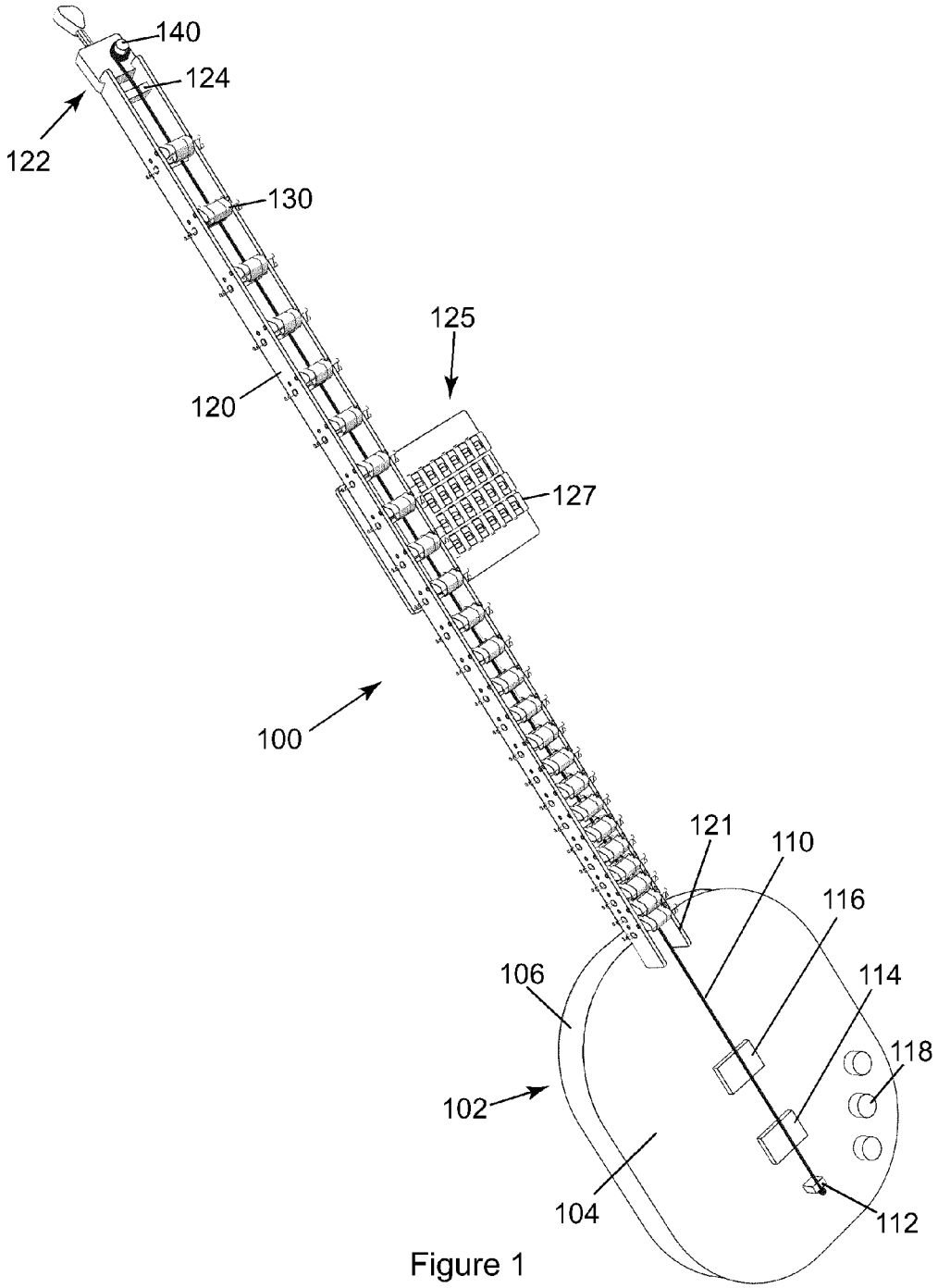
FIG. 1 is a perspective view of one embodiment of a musical instrument.

The methods, the devices, and the systems provided herein provide for the control of a vibrating string. In some embodiments the methods, devices, and systems discussed herein can provide for an instrument and methods of playing the instrument. In some embodiments, the instrument can include a body, a neck, a string having a first end and a second end. In some embodiments the string is anchored at the first end to the body and at the second end to the neck. In some embodiments the instrument can further include one or several clamping mechanisms which can be positioned, for example, along the string and/or in or along the neck. In some embodiments, the clamping mechanism can comprise a first clamping member, and a second clamping member.

The instrument can further include a control panel comprising one or several control members. In some embodiments a control member in the control panel is associated with a clamping mechanism so as to control the operation of the clamping mechanism by the manipulation of the control member. The controlling connection between the control member in the control panel and the clamping mechanism can be created in a variety of fashions including, for example, via a cable or other mechanical linkage, via an electrical connection, such as, for example, via components configured to transmit control signals from a control member to an actuator associated with the clamping mechanism, or via any other desired system, device, or component configured to allow controlling of the clamping mechanism via the manipulation of the control member.

Some embodiments relate to a clamping mechanism. In some embodiments the clamping mechanism can comprise a first clamping member. In some embodiments, the first clamping member can include a clamping body. In some embodiments, a clamping pad can be located on the clamping body, and a first camming surface. In some embodiments the clamping mechanism can further include a second clamping member. The second clamping member can include a second clamping body, a second clamping pad, and a second camming surface. In some embodiments the first camming surface and the surface camming surface can be configured to interact with each other such that movement of the first clamping member is transmitted to the second clamping member. Thus, in some embodiments, movement of the first clamping member results in movement of the second clamping member.

Some embodiments relate to an instrument comprising a string anchored at its first and second ends, and configured to vibrate between the first and second ends. In some embodiments the instrument can further comprise a clamping mechanism. This clamping mechanism can, for example, be positioned between the first and second ends of the string. In some embodiments the clamping mechanism can comprise a first clamping member, and a second clamping member. These clamping members can, for example, interact with each other to clamp on or around the string. In some embodiments the instrument further comprises a control panel. The control panel can, for example, include a control member that is connected, and in some embodiments that is operatingly connected, to the clamping mechanism. In some embodiments, the control panel can include a plurality of control members. In some embodiments, the operating connection of the control member to the clamping mechanism allows the control member to control the clamping mechanism. Thus, the manipulation of the control member controls whether the clamping mechanism clamps on or around the string. In some embodiments, the operation of the clamping mechanism, via the control member, changes the natural frequency of the string.

The Musical Instrument

FIG. 1 depicts one embodiment of a musical instrument 100. The musical instrument 100 can be configured to make music. The musical instrument 100 can comprise a variety of shapes and sizes and can be made from a variety of materials including, a manmade material, a natural material, wood, a synthetic material, a composite, a metal, and/or any other desired material.

In some embodiments the musical instrument 100 can comprise a body 102. The body 102 can be configured to connect to and support features of the musical instrument 100, and/or to facilitate in making music. In some embodiments, for example, the body 102 can comprise features configured to facilitate making music or to transmit signals corresponding to music. In some embodiments, the body can be configured to generate sound waves in the air. The body 102 can comprise a variety of shapes and sizes and can be made from a variety of materials. In some embodiments, the body 102 can comprise a face 104, at least one side 106, and a back 108 (not shown). In some embodiments the face 104 and the back 108 comprises surfaces, which can be, for example; substantially planar and substantially parallel. In some embodiments, the face 104 and the back 108 are nonparallel. The side 106 can comprise surfaces and can extend from the face 104 to the back 108. In some embodiments, the sides 106, can extend substantially perpendicular to the face 104 and to the back 108.

The body 102 can comprise a variety of sizes, and can be defined by a variety of dimensions. In some embodiments, the body 102, can be defined by a length, a width, and a height. In some embodiments, the body 102, can be defined by a radius, and a thickness. In some embodiments, the body 102, can comprise the length of approximately 36 inches, 24 inches, 18 inches, 12 inches, six inches, three inches, one inch, 0.5 inches, 0.25 inches, or any other desired or intermediate length. In some embodiments, the body 102, can comprise a width of approximately 36 inches, 24 inches, 18 inches, 12 inches, six inches, three inches, one inch, or any other desired or intermediate width. In some embodiments, the body 102, can comprise a thickness of approximately 12 inches, nine inches, six inches, three inches, two inches, one inch, one-half inch, one-quarter inch, or any other desired or intermediate thickness.

The musical instrument 100 can further comprise, as depicted in FIG. 1, a string 110. The string 110 can comprise, for example, a variety of lengths, thicknesses, cross-sectional shapes, and materials. In some embodiments, the string 110, can comprise a wire, a strip, metallic string, a non-metallic string, a manmade string, a natural string, or a string of any other desired and suitable material. In some embodiments, the string 110, can comprise a thickness of approximately 0.01 inches, 0.1 inch, 0.2 inches, 0.3 inches, 0.4 inches, 0.5 inches, one inch, or any other desired or intermediate thickness. In some embodiments the string 110, can comprise a length of, for example, 0.5 inches, one inch, two inches, three inches, six inches, 12 inches, 18 inches, 24 inches, 36 inches, 48 inches, 60 inches, 72 inches, 84 inches, 96 inches, 105 inches, 120 inches or any other desired or intermediate length.

In some embodiments the string can comprise a variety of cross-sectional shapes. In some embodiments, the string 110, can comprise a circular cross-sectional shape, a rectangular shape, a triangular cross-sectional shape, an ovular cross-sectional shape, a pentagonal cross-sectional shape, a hexagonal cross-sectional shape, an octagonal cross-sectional shape, or any other desired cross-sectional shape.

In some embodiments, the string 110, can be configured to generate sound by vibrating. In some embodiments the properties of the string 110, such as, for example, the length of the string 110, the thickness of the string 110, the material of the string 110, the cross-sectional shape of the string 110, and a variety of other properties, can determine the vibrational frequency of the string 110. In some embodiments, varying the length of the string 110, can vary the frequency with which the string 110 vibrates. In some embodiments, varying the tension of the string 110, can likewise alter the frequency of vibration of the string 110.

As depicted in FIG. 1, in some embodiments of the musical instrument 100, the string 110 can be affixed to the body 102 of the musical instrument 100. In some embodiments, the string 110 can be affixed to the musical instrument via a bridge 112. The bridge 112 can comprise a variety of materials and can be made in a variety of shapes and sizes. In some embodiments, the bridge 112, can be located in any desired position on the body 102. In some embodiments, the bridge 112, can be configured to securely anchor the string 110 to the body 102. In some embodiments, the bridge 112, can be configured to allow the string 110 to vibrate and thereby create music.

In some embodiments, the bridge 112, can be made from any desired material including, for example, wood, metal, plastic, a natural material, a synthetic material, a manmade material, or any other desired material. In some embodiments the bridge 112 can have a variety of shapes. In some embodiments, the shape of the bridge 112, can be configured to facilitate the secure anchoring of the string 110.

As discussed above, in some embodiments of the musical instrument 100, the body 102 can be configured to transmit vibrations from the string 110 to the air surrounding the body 102. In some embodiments, the musical instrument 100, can be configured to transmit vibrations from the string 110 to an amplifier (not shown). In some embodiments, the musical instrument 100 can transmit vibrations from a string 110 to an amplifier via a jack located on the musical instrument 100, and through a cable connecting to the musical instrument 100 through the jack, and to the amplifier. In some embodiments, the transmission of vibrations from the string 110, is facilitated by one or several pickups located on the body 102. In some embodiments, the pickups located on the body 102, can be configured to detect the vibrations of the string 110, and to transform the vibrations of the string 110 into an amplifiable and/or electrical signal.

As depicted in FIG. 1, the musical instrument 100, can comprise a first pickup 114 and a second pickup 116. In some embodiments, the first pickup 114, can be located proximate to the bridge 112. In some embodiments, the location of the first pickup 114 and the second pickup 116 can affect the ability of the musical instrument 100, to detect the vibration of the string 110, and to amplify and/or transmit and transform the vibrations of the string 110 into electrical signals. In some embodiments, the number of pickups 114, 116 can further affect the ability of the musical instrument 100 to detect the vibrations of the string 110 and to amplify and/or transmit and transform the vibrations of the string 110. A person of skill in the art will recognize that the present disclosure contemplates one or several pickups and is not limited to the specific number of pickups depicted in FIG. 1. A person of skill in the art will further recognize that the present disclosure is not limited to the specific positions of the pickups 114, 116 depicted in FIG. 1.

In some embodiments, the body 102 of the musical instrument 100, can comprise one or several controls. In some embodiments, these controls can be configured to affect the volume of the musical instrument 100, the tone of the musical instrument 100, or any other parameter relating to the sound created by the musical instrument 100, or the signal generated by the musical instrument 100. As depicted in FIG. 1, in some embodiments, these controls can comprise one or several knobs 118. In some embodiments, these knobs 118, can comprise a variety of sizes and shapes, and can be located in a variety of positions on the body 102. In some embodiments, a single knob 118 can control a single parameter of the sound generated by the musical instrument 100 or of the signal generated by the musical instrument 100.

As depicted in FIG. 1, the musical instrument 100, can further comprise a neck 120. The neck 120 can comprise a variety of sizes and shapes. In some embodiments, the neck 120, can be located in a variety of positions on the musical instrument 100. In some embodiments, the neck can comprise a first end 122 and a second end 124. In some embodiments, the first end 122 of the neck 120 can be affixed to the body 102 of the musical instrument 100. In some embodiments, and as depicted in FIG. 1, the first end 122 of the neck 120 can be affixed to the face 104 of the body 102. In some embodiments, the neck 120, can extend parallel to the face 104 of the body 102. In some embodiments, the neck 120, can extend nonparallel to the face 104 of the body 102.

In some embodiments of the musical instrument 100, the neck 120, can be configured to affix the second end of the string 110. In some embodiments, the second end of the string 110, can be affixed to the tuning post 140 at the second end 122 of the neck 120. Thus, in some embodiments, and as depicted in FIG. 1, the string 110 is anchored between the second end 122 of the neck 120, and the bridge 112 affixed to the body 102. In some embodiments, the string 110, is tensioned between the tuning post 140 and the bridge 112.

In some embodiments, the string 110, can be configured to vibrate between the nut 124, and the bridge 112 affixed to the body 102.

In some embodiments, the musical instrument may be, for example, a guitar, a bass guitar, a bass, a cello, a violin, a viola, or a harp. However, it will be appreciated that the musical instruments may be any musical instrument compatible with the control panel described herein.

Figure 2:
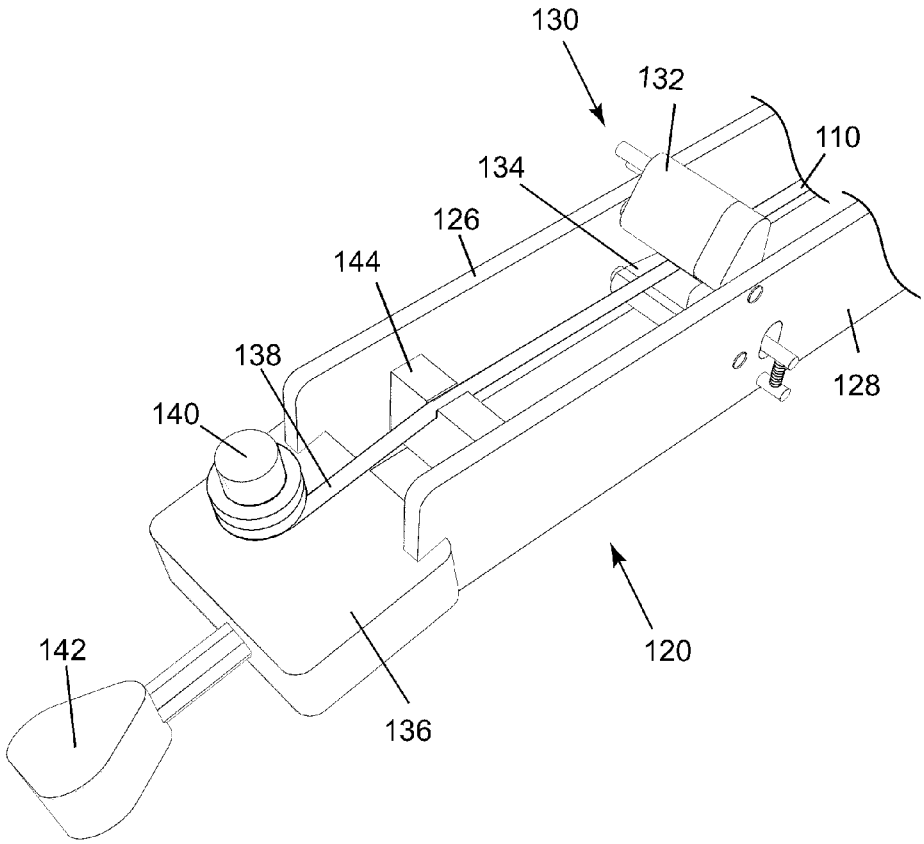
FIG. 2 is a perspective view of a portion of one embodiment of a musical instrument.

FIG. 2 depicts one embodiment of the second end 124 of the neck 120. As depicted in FIG. 2, in some embodiments, the neck 120, can comprise a first side 126 and a second side 128. In some embodiments, the first side 126 of the neck 120 is parallel to the second side 128 of the neck 120. In some embodiments, the first side 126 of the neck 120, is nonparallel to the second side 128 of the neck 120. In some embodiments, the neck 120, can further comprise one or several members connecting the first side 126 of the neck 120 with the second side 128 of the neck 120.

In some embodiments, and as depicted in FIG. 1, one or several clamping mechanisms 130, can be located between the first side 126 of the neck 120, and the second side 128 of the neck 120. In some embodiments, the clamping mechanism 130, can be located between the nut 124 affixed to the neck 120 and the bridge 112 affixed to the body 102.

In some embodiments, the clamping mechanism 130 can comprise a variety of shapes and sizes. In some embodiments, the clamping mechanism 130 can be made from a variety of materials. In some embodiments, the clamping mechanism can be made from a natural material, a synthetic material, a manmade material, metal, polymer, plastic, a composite material, or any other desired or combination of materials.

In some embodiments, the clamping mechanism 130 can be statically or dynamically connected to the neck 120. In some embodiments in which the clamping mechanism 130 is dynamically connected to the neck 120, the clamping mechanism can be configured to clamp onto or around the string 110. In some embodiments, the clamping mechanism 130 can be configured to clamp onto or around the string 110 at a position between the second end 128 of the neck 120 and the bridge 112 affixed to the body 102. In some embodiments, the clamping of the clamping mechanism 130 onto or around the string 110 divides the string into a first portion and a second portion. In some embodiments, the first portion of the string 110 can be configured to vibrate. In some embodiments, the first and second portions of the string 110 can be configured to independently vibrate.

In some embodiments, the clamping of the clamping mechanism 130 onto or around the string 110, results in the shortening of the portion of the string 110 vibrating over the body 102 or over the pickups 114, 116 on the body 102. In some embodiments, the shortening of the portion of the string 110 vibrating over the body 102 and/or over the pickups 114, 116 of the body 102 can change the frequency of the vibrating string 110. In some embodiments, the change in the frequency of vibration of the string 110, can correspond to a change in the frequency of the sound generated by the musical instrument 100. Thus, in some embodiments, the clamping mechanism 130 can be configured to change the sound generated by the musical instrument 100.

As further depicted in FIG. 2, in some embodiments, the clamping mechanism 130 can comprise a first clamping member 132. In some embodiments, the first clamping member 132 of the clamping mechanism 130 can clamp onto or around the string 110. In some embodiments, the first clamping member 132 of the clamping mechanism 130 can clamp against a portion of the musical instrument 100 such as, for example, the neck 120.

In some embodiments, such as the embodiment depicted in FIG. 2, the first clamping member 132 can cooperate with a second clamping member 134. However, it will be appreciated that embodiments lacking a second clamping member can be constructed by eliminating the second clamping member and its associated features from the embodiments shown in FIGS. 2-5. Some of these features, such as, for example, the expansion mechanism, may be applied to the first clamping member.

In some embodiments, the first clamping member 132 can interact with the second clamping member 134 to clamp onto or around the string 110. In some embodiments, the first clamping member 132 can cooperate with the second clamping member 134 to clamp onto or around the string 110. In some embodiments, the first clamping member 132 can independently clamp onto or around the string 110. In some embodiments, the second clamping member 134 can independently clamp onto or around the string 110. The first clamping member 132 and the second clamping member 134 can comprise a variety of shapes and sizes and can be made from a variety of materials. The specific features of the first clamping member 132 and the second clamping member 134 will be described in further detail below.

As depicted in FIG. 2, some embodiments of the second end 122 of the neck 120 can include features configured to allow the affixation of the string 110 to the second end 122 of the neck 120. In some embodiments these features can include, for example, a tuning plate 136. The tuning plate 136 can comprise a variety of shapes and sizes and materials. In some embodiments, the tuning plate 136 can be affixed to the second end 122 of the neck 120. In some embodiments in which the neck 120 comprises a first side 126 and a second side 128, the tuning plate 136 can be affixed to the first side 126 of the neck and to the second side 128 of the neck. In some embodiments, and as depicted in FIG. 2, the tuning plate 136 can include features configured to facilitate the anchoring and/or tension adjustment of the string 110. In some embodiments and as depicted in FIG. 2, the tuning plate 136 can include features configured to engage with the second end 138 of the string 110.

In some embodiments, the tuning plate 136, can include a tuning post 140. The tuning post 140 can comprise a variety of shapes and sizes. In some embodiments, the tuning post 140 can extend from the tuning plate 136. In some embodiments, and as depicted in FIG. 2, the tuning post 140, can extend perpendicular to the tuning plate 136. As depicted in FIG. 2, the tuning post 140 can comprise a cylindrically shaped member perpendicularly extending from the tuning plate 136. In some embodiments, and as depicted in FIG. 2, the second end 138 of the string 110 can be wrapped around the tuning post.

In some embodiments, the tuning post 140 can be controllably connected to a tuning key 142. The tuning key 142 can comprise a variety of shapes and sizes and can be made of a variety of materials. In some embodiments, the tuning key 142, can be connected to the tuning plate 136. In some embodiments, the tuning key 142 can be further controllingly connected with the tuning post 140 such that the manipulation of the tuning key 142 results in movement of the tuning post 140. In some embodiments, the movement of the tuning post 140, can affect the tension of the string 110. In some embodiments, embodiments of a tuning post 140 in which the second end 138 of the string 110. Thus, in some embodiments, the manipulation of the tuning key 142 can result in an increase or a decrease in the length of string 110 to thereby affect the tension of the string 110.

Some embodiments of features configured to anchor the string 110 to the second end 128 of the neck 120 and/or for the adjustment of tension of the string 110 can include a nut 144. In some embodiments, the nut 144, can comprise a variety of shapes and sizes, and can be made from a variety of materials. In some embodiments, the nut 144, can be located proximate to the tuning plate 136. In some embodiments, and as depicted in FIG. 2, the nut 144 can be located between the first side 126 and the second side 128 of the neck 120. In some embodiments, and as depicted in FIG. 2, portions of the second end 138 of the string 110 contact the nut 144. In some embodiments, the tuning key 142 can be used to cause rotation of the tuning post 140 and to thereby affect the tensioning of the string 110, which change in the string 110 tensioning likewise results in a change in the frequency of the strings 110 vibration.

Returning again to FIG. 1, FIG. 1 further depicts a control panel 125, a control member 127, and a clamping mechanism 130.

The control panel 125 can comprise one or several control members 127. In some embodiments, activation of each control member 127 is communicated to a clamping mechanism 130 causing the clamping mechanism 130 down on a string 110 or to contact a sound generating component at a desired location so as to cause the musical instrument 100 to play a desired note. In some embodiments, the control panel 125 can comprise a variety of shapes and sizes and can be made from a variety of materials. In some embodiments, the control panel can be affixed to the neck 120, and/or can extend from the neck 120. However, it will be appreciated that the control panel may be positioned at any location compatible with its intended function. In some embodiments, the control panel can be sized and shaped to allow a user to access all of the control members 127 on the control panel 125. The specific structure and detailed description of the features and functions of the control panel 125 will be discussed in further detail below.

The control member 127 can be configured to allow a user to control the operation of the clamping mechanism 130. In some embodiments, and as shown in FIG. 1, the control member 127 can be located in the control panel 125. In some embodiments, the manipulation of the control member 127 results in the movement of the clamping mechanism 130 and more specifically results in the movement of the clamping mechanism 130 from a first position in which the clamping mechanism 130 is not clamping onto or around the string 110 into a second position in which the clamping mechanism 130 is clamping onto or around the string 110. A person of skill in the art will recognize that a control member 127 can comprise a variety of sizes and shapes and be located in a number of positions on the control panel 125, and that the present disclosure is not limited to the specific embodiments of the control member 127 described herein.

The Clamping Mechanism

Figure 3:
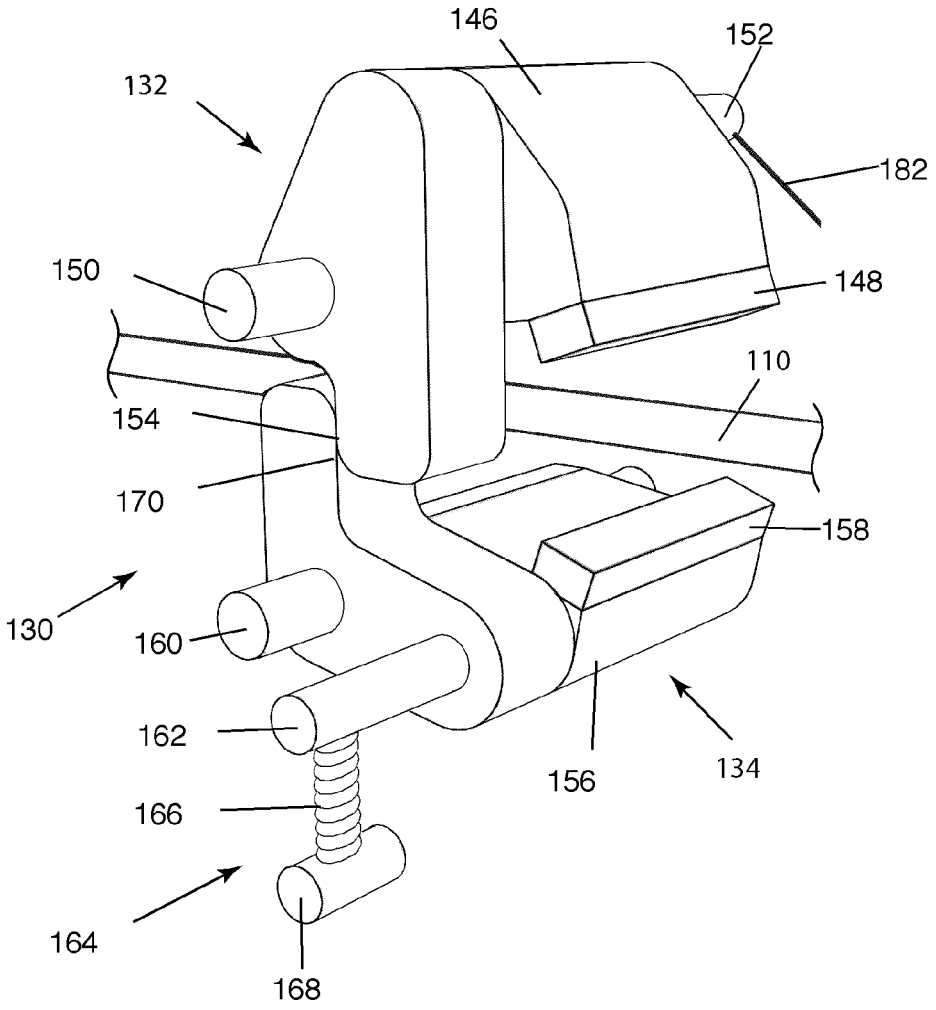
FIG. 3 is a perspective view of one embodiment of a string and a clamping mechanism.

FIG. 3 depicts a perspective view of one embodiment of the clamping mechanism 130. As discussed above, the clamping mechanism 130 can comprise a variety of shapes, sizes, and components, and can be made of a variety of materials. As depicted in FIG. 3 the clamping mechanism comprises a first clamping member 132 and a second clamping member 134. As further depicted in FIG. 3 the first clamping member 132 can comprise, for example, a first clamping body 146, a first clamping pad 148, a first axle 150, a first actuation lever 152, and/or a first camming surface 154. In some embodiments of the clamping mechanism 130, the first clamping member 132 can comprise more or fewer components than those listed above.

The clamping body 146 can comprise a variety of shapes and sizes and can be made of a variety of materials. In some embodiments, the first clamping body, can be sized, shaped, and dimensioned to withstand the loads associated with clamping onto or around the string 110. In some embodiments, the first clamping body 146, can be configured to connect to a plurality of other components of the first clamping member 132.

In some embodiments, the first clamping body 146 can connect to the first clamping pad 148. In some embodiments, the first clamping pad 148 is adhered to a surface of the first clamping body 146. In some embodiments, the surface of the first clamping body 146 to which the first clamping pad 148 is affixed is substantially perpendicular to the longitudinal axis of the string 110 when the first clamping member 132 is clamped onto or around the string 110.

The first clamping pad 148 can comprise a variety of shapes and sizes, and can be made from a variety of materials. In some embodiments, and as depicted in FIG. 3, the first clamping pad 148 can comprise a rectangular cross-section. In some embodiments, the first clamping pad 148 can comprise a variety of other cross-sections. In some embodiments, the first clamping pad 148 can comprise a material that facilitates the clamping of the first clamping member 132 onto or around the string. In some embodiments, the first clamping pad 148 can comprise, for example, a natural material, a synthetic material, a manmade material, a composite material, a polymer, a plastic, or any other desired material. In some embodiments, the first clamping pad 148 can comprise, for example, a felt pad, a rubber pad, a foam pad, a leather pad, a cloth pad, or a pad comprising any other desired material. In some embodiments, the first clamping pad 148, comprise a material configured to clamp onto or around the string 110 such that the vibrations of the string 110 are isolated between the first clamping member 132 and the bridge 112.

In some embodiments, and as depicted in FIG. 3, some embodiments of the first clamping body 146 can comprise, for example, the first axle 150. The first axle 150 can comprise a variety of shapes and sizes, and can be located in a variety of positions on the first clamping member 132. In some embodiments, the first axle 150, can comprise an approximately cylindrical protuberance from the first clamping body 146. In some embodiments, the first clamping member 132 can be located about an axis defined by the first axle 150.

Some embodiments of the first clamping body 146 can further include, and/or be further affixed to an actuation lever 152. The actuation lever 152 can comprise a variety of shapes and sizes and can be made from a variety of materials. In some embodiments, the actuation lever 152, can be located in a variety of positions on the first clamping body 146 of the first clamping member 132. In some embodiments, the first actuation lever 152 is positioned such that the distance between the first actuation lever 152 and the first axle 150 is configured to minimize the moment required to rotate the first clamping member 132 about the axis of rotation defined by the first axle 150.

In some embodiments, the actuation lever 152, is configured to receive a control line and/or any other features to allow the manipulation of the first clamping member 132.

In some embodiments, and as depicted in FIG. 3, the first camming surface 154 can be configured to interact with a camming surface of the second clamping member 134. In some embodiments, the interaction of the first camming surface 154 with similar features of the second clamping member 134 can be configured to transfer rotations of the first clamping member 132 about the first axle 150 in a first direction to the second clamping member 134. Thus, in some embodiments, the first camming surface 154 is configured to transfer motions to the second clamping member 134 when the motions are in the desired direction.

As depicted in FIG. 3 the second clamping body 134 can likewise comprises a plurality of features and components configured to facilitate in the clamping onto or around of the string 110. In some embodiments, the second clamping mechanism 134 can comprise, for example, a second clamping body 156, a second clamping pad 158, a second axle 160, a second actuation lever 162, and an expansion mechanism 164 comprising an expansion spring 166 and an expansion spring anchor 168, and a second camming surface 170.

The second clamping body 156 can comprise a variety of shapes and sizes and can be made of a variety of materials. FIG. 3 depicts one embodiment of the shapes that can be used to form the second clamping body 156. A person skilled in the art will recognize that the present disclosure is not limited to the specific shapes depicted in the embodiment of FIG. 3.

The second clamping body 156 can be further configured to clamp onto or around the string 110. In some embodiments, the second clamping body 156 can comprise a variety of features and components configured to facilitate the clamping of the second clamping body 156 onto or around the string 110. A person of skill in the art will recognize the second clamping body 156 can comprise more or fewer features than those depicted in FIG. 3 and those discussed herein below.

The second clamping pad 158 can comprise a variety of sizes and shapes and can be made from a number of materials. As discussed above and similar to the first clamping pad 148, the second clamping pad 158 can be configured to clamp onto or around the string 110 so as to shorten the portion of the string vibrating over the body 102 of the musical instrument 100. As depicted in FIG. 3 the second clamping body 158 can have a rectangular cross-section. In some embodiments, the second clamping pad 158 can comprise a variety of other cross-sections including, for example, a circular cross-section, an ovular cross-section, a triangular cross-section, a rectangular cross-section, a pentagonal cross-section, a hexagonal cross-section, an octagonal cross-section, or any other desired cross-section. In some embodiments, the second clamping pad can be made from a variety of materials including, for example, a natural material, a manmade material, cloth, felt, rubber, a composite material, cork, and/or any other desired material. As also depicted in FIG. 3, the second clamping pad 158 can be located on a surface of the second clamping body 156, which surface is substantially parallel to the longitudinal axis of the string 110 when the second clamping member 134 is clamped onto or around the string 110.

The second clamping body 156 can include the second axle 160. The second axle 160 can comprise a variety of shapes and sizes and can be made from a variety of materials. As depicted in FIG. 3, and similar to the first axle 150 depicted in FIG. 3, the second axle 160 comprises a cylindrical protuberance extending from the second clamping body 156. Likewise similar to the first axle 150, the second clamping body 156 rotates about an axis of rotation defined by the second axle 160.

The second clamping body 156 is further connected to the second actuation lever 162. The second actuation lever 162 can comprise a variety of shapes and sizes and can be made of a variety of materials. Similar to the second axle 160, the second actuation lever 162, as depicted in FIG. 3, comprises cylindrical protuberance extending from the second clamping body 156. The second actuation lever 162 can be located in a variety of positions on the second clamping body 156. In some embodiments, and as depicted in FIG. 3, the second actuation lever 162 can be located at a position on the second clamping body 156 such that the distance between the second actuation lever 162 and the second axle 160 is maximized. In some embodiments, the positioning of the second actuation lever 162 at the greatest distance from the second axle 160 can decrease the amount of force required to rotate the second clamping body 156 about the second axle 160.

Some embodiments of the second clamping member 134 can further include a mechanism configured to apply a force to the second actuation lever 162 to rotate the second clamping body 156 about the second axle 160. FIG. 3 depicts one embodiment of the second clamping member 134 including an expansion mechanism 164. As depicted in FIG. 3, the expansion mechanism can include, for example, an expansion spring 166 and a spring anchor 168.

In some embodiments, the expansion spring 166 can be configured to apply a force to the second actuation lever 162. The expansion spring can comprise a rubber band, any type of spring, or a tension creating member. In some embodiments in which the expansion spring 166 comprises a linear spring, the expansion spring 166 will apply a force to the second actuation lever 162 in a single direction. In some embodiments, the expansion spring 166 can be configured to bias the second clamping body 156 into a first position in which the second clamping body 156 is clamping onto or around the string 110, or into a second position in which the second clamping body 156 is not clamping onto or around the string 110.

In some embodiments, the expansion spring 166 can comprise any desired spring having any desired size and shape and made from any desired material. In some embodiments, the expansion spring 166 can be made of a combination of these materials and dimensions so as to allow the biasing of the second clamping body 156 into a second position in which the second clamping body 156 is not clamping onto or around the string 110. In some embodiments, the expansion spring 166 is affixed at its first end to the second actuation lever 162, and affixed at its second end to a spring anchor 168. In some embodiments, the spring anchor 168 can comprise a variety of shapes and sizes and can be made of a variety of materials. In some embodiments, the spring anchor 168 is anchored into the neck 120 so as to allow a force to be applied to the second actuation lever 162 via the expansion spring 166. As depicted in FIG. 3, the spring anchor 168 can comprise a cylindrical protuberance which can, for example, extend from one of the first side 126 and/or the second side 128 of the neck 120.

Some embodiments of the second clamping body 156 can further include, for example, the second camming surface 170. In some embodiments, and similar to the first camming surface 154, the second camming surface 170 can be configured to transfer force and/or motion from the second clamping body 156 to the first camming surface 154 with which the second camming surface 170 is interacting. As depicted in FIG. 3, the second camming surface 170 is configured to interact with the first camming surface 154. In some embodiments, and similar to that discussed above, the interaction of the second camming surface 170 with the first camming surface 154 can be configured to transfer a first rotation, and as seen in FIG. 3, a first clockwise rotation about the second axle 160, to the first clamping body 146. As also seen in FIG. 3 due to the shape and positioning of the second camming surface 170 and the first camming surface 154, the second camming surface 170 is not configured to transfer a counterclockwise rotation from the second clamping body 156 to the first clamping body 146. Thus, in referring to the embodiment of the clamping mechanism 130 depicted in FIG. 3, if the expansion spring 166 were applying a tensile force to the second actuation lever 162, the second camming surface 170 would apply a like force to the first camming surface 154.

Figure 4:
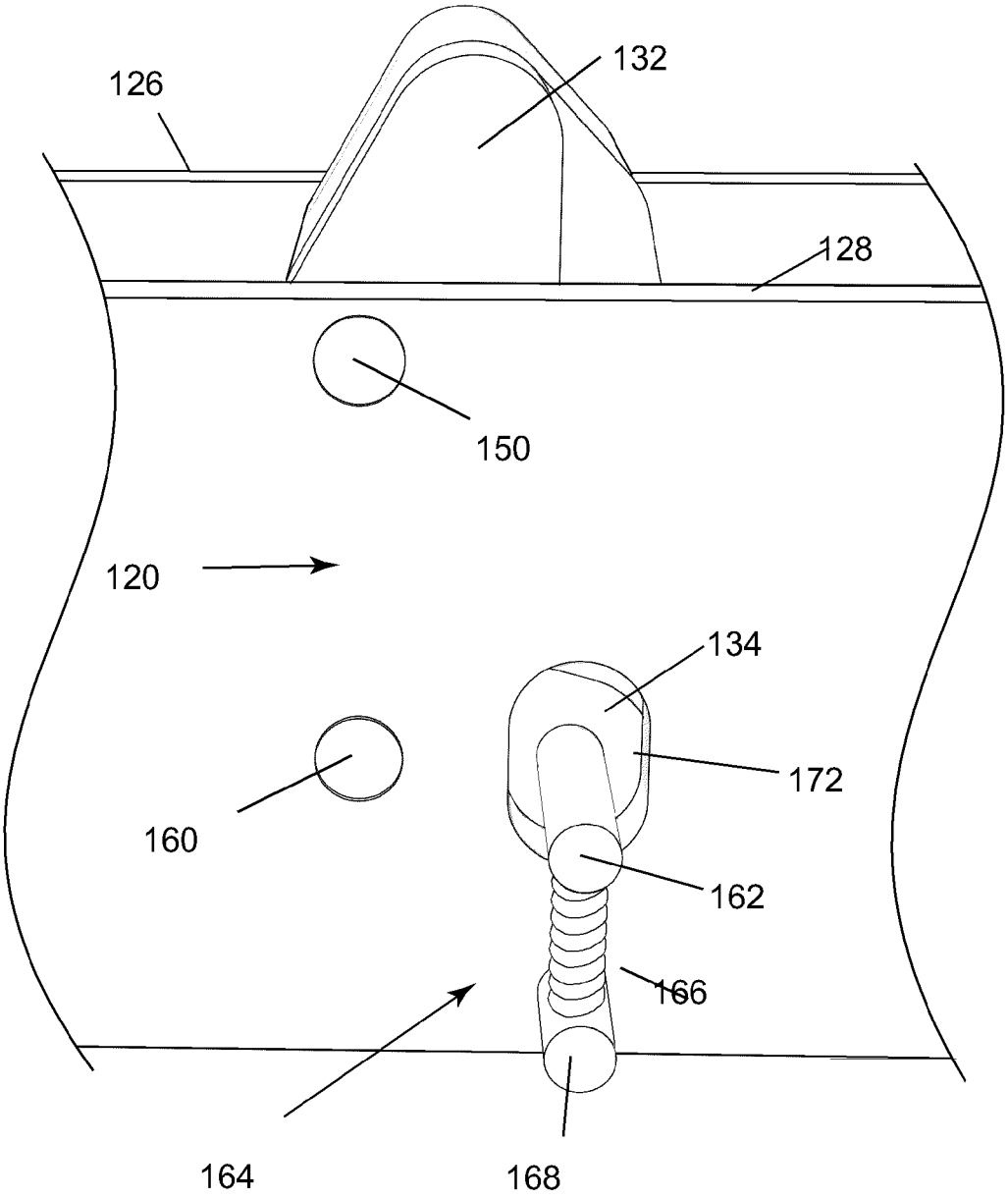
FIG. 4 is a perspective view of one embodiment of a clamping mechanism in a neck of the musical instrument.

A person of skill in the art will recognize that the above description and disclosure relating to the clamping mechanism 130 is not limited to the specific embodiments and/or specific features of the above discussed first and second clamping members 132, 134. A person of skill in the art will further recognize that the clamping mechanism 130 can comprise more or fewer components than those discussed above. FIG. 4 depicts one embodiment of a clamping mechanism 130 positioned within the neck 120. Specifically, FIG. 4 depicts one embodiment of a clamping mechanism 130 positioned between the first side 126 of the neck 120 and the second side 128 of the neck 120. As seen in FIG. 4, the first axle 150 of the first clamping member 132 extends through the second side 128 of the neck 120. As also seen in FIG. 4, the second axle 160 of the second clamping member 134 extends through the second side 128 of the neck 120. In addition to the second axle 160 of the second clamping member 134 extending through the second side 128 of the neck 120, the second actuation lever 162 extends through a hole 172 in the second side 128 of the neck. The hole 172 can comprise a variety of shapes and sizes, and can be configured to allow movement of the second actuation lever 162 between a first position in which the second clamping member 134 is clamping onto or around the string 110 and the second position in which the second clamping member 134 is not clamping onto or around the string 110. As also seen in FIG. 4, the expansion mechanism 164 interacts with the second actuation lever 162 which extends to hole 172 in the second de 128 of the neck 120. As seen in FIG. 4, the expansion spring 166 connects at its first end with the second actuation lever 162 and at its second end with the spring anchor 168, which spring anchor 168 is attached to the second side 128 of the neck 120.

A person of skill in the art will recognize that FIG. 4 depicts one embodiment of features and methods of connecting a clamping mechanism 130 to a neck 120, and that the above disclosure includes combinations and devices having more or fewer features and components than those discussed above.

The Control Panel and Control Connections

Figure 5:
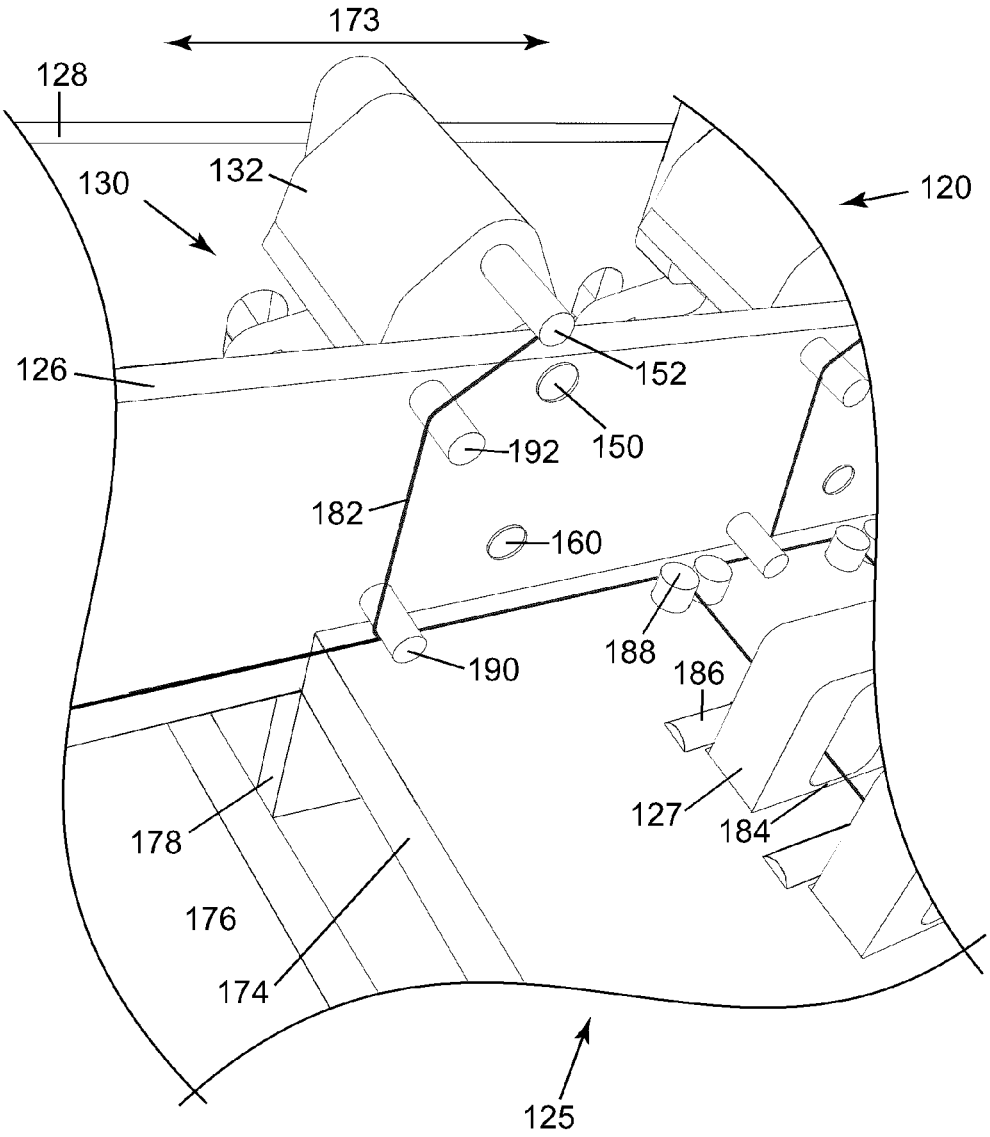
FIG. 5 is a perspective view of one embodiment of a control panel on a musical instrument.

FIG. 5 depicts one embodiment of the musical instrument 100. As depicted in FIG. 5, the musical instrument 100 comprises the neck 120 having the first side 126 and the second side 128. As also seen in FIG. 5, the musical instrument 100 comprises a plurality of the clamping mechanisms 130. As seen in FIG. 5, the clamping mechanisms 130 comprise a first clamping member 132. The second clamping member 134 is not visible in FIG. 5. The first clamping member 132 as seen in FIG. 5 includes a first axle 150 and a first actuation lever 152. The first clamping axle 150 extends through the second side 128 of the neck 120. Although the second clamping member 134 is not visible in FIG. 5, the second axle 160 is visible as extending through the second side 128 of the neck.

The musical instrument 100 depicted in FIG. 5 further includes the control panel 125. As see in FIG. 5, the control panel 125 is connected to the first side 126 of the neck 120 and extends from the first side 126 of the neck 120 perpendicular to the longitudinal axis 173 of the neck 120, which longitudinal axis 173 extends between the first neck end 122 and the second neck end 124. In some embodiments, and as depicted in FIG. 5, the control panel 125 can comprise, for example, an upper plate 174, a lower plate 176, and one or more side plates 178.

The upper plate 174 of the control panel 125 can comprise a variety of shapes and sizes. In some embodiments, the upper plate 174 can be connected to and/or integrally formed with the neck 120 and/or a portion of the neck 120. In some embodiments, the upper plate 174 can be configured to hold one or several control members 127. In some embodiments, the upper plate 174 can comprise a planar surface, or an approximately planar surface. In some embodiments, the upper plate 174 can comprise one or several holes 180. In some embodiments, the holes 180 can be configured to receive the control members 127.

The lower plate 176 can comprise a variety of shapes and sizes and can be made from a variety of materials. In some embodiments, the lower plate 176 can extend from the neck 120 of the musical instrument 100 offset from, and parallel to the upper plate 174. In some embodiments, the lower plate 176 can comprise a planar surface and/or a substantially planar surface.

The upper plate 174 and the lower plate 176 of the control panel 125 can be connected by one or more side plates 178. The side plates can comprise a variety of shapes and sizes and can be made from a variety of materials. In some embodiments, a first portion of the side plate 178 can connect to the upper plate 174 and a second portion of the side plate 178 can connect to the lower plate 176. This connection of a first portion of the side plate 178 to the upper plate 174 and a second portion of the side plate 178 to the lower plate 176 separates the upper plate 174 from the lower plate 176. In some embodiments, the distance between the first portion of the side plate 178 and the second portion of the side plate 178 is configured to allow movement of one or several control members 127 from a first position to a second position. In some embodiments, the movement of one or several control members 127 from a first position to a second position can tension and/or displace one or several transmission cables 180.

The transmission cable 180 can comprise a variety of shapes and sizes and can be made from a variety of materials. In some embodiments, the transmission cable 180 can comprise, for example, an elongate, flexible member configured to allow the transmission of tension from the control member 127 to the clamping mechanism 130. In some embodiments, the transmission cable 180 can be sized and shaped, and made from a material such that the transmission cable 180 withstands the forces applied to the transmission cable 180 during the manipulation of the control member 127 and the thereby resulting movement of the clamping mechanism 130. In some embodiments, for example, the transmission cable 180 can comprise a wire, a string, a thread, a fiber, a line, a chain, a cable, and/or any other desired object configured to transfer force from the control member 127 to the clamping mechanism 130. In some embodiments, for example, the transmission cable 180 can comprise, for example, a braided plastic line such as, for example, a fishing line. In some embodiments, a first end of the transmission cable 182 can be connected to the control member 127, and a second end of the transmission cable 182 can be connected to the first actuation lever 152 of the first clamping member 132.

The control members 127 can be configured to receive a user input and to allow the user to manipulate the clamping mechanism 130 via manipulation of the control member 127. In some embodiments, the control member 127 can comprise a variety of shapes and sizes and can be made from a variety of materials. In some embodiments in which the control member 127 is inserted into a hole 180 in the control panel 125, the size and shape of the control member 127 can be configured to correspond to the size and shape of the hole 180 to thereby allow the control member to be displaced relative to the upper plate 174 of the control panel 125. In some embodiments, the control member 127 can comprise features configured to retain the control member 127 within the hole 180 of the control panel 125. In some embodiments, these retaining features can comprise, for example, a flange or other dimensional expansion (not shown) located at one end of the control member 127 positioned below the upper plate 174. In some embodiments, this flange or dimensional expansion of the control member 127 can prevent the control member 127 from moving out of and above the upper plate 174. In some embodiments, the control member 127 can comprise, for example, a control member hole 184. The control member hole 184 can comprise a variety of shapes and sizes and can be located in a variety of positions on the control member 127. In some embodiments, the control member hole 184 can comprise a surface configured for affixation to a first portion of the transmission cable 182. In some embodiments, the affixation of the transmission cable 182 to a portion of the control member 127 allows the tensioning of the transmission cable 182 when the control member 127 is moved from a first position to a second position. In some embodiments, the transmission cable 182, which is routed to the clamping mechanism 130, transmits force arising from the manipulation of the control member 127 to the clamping mechanism 130.

Figure 6:
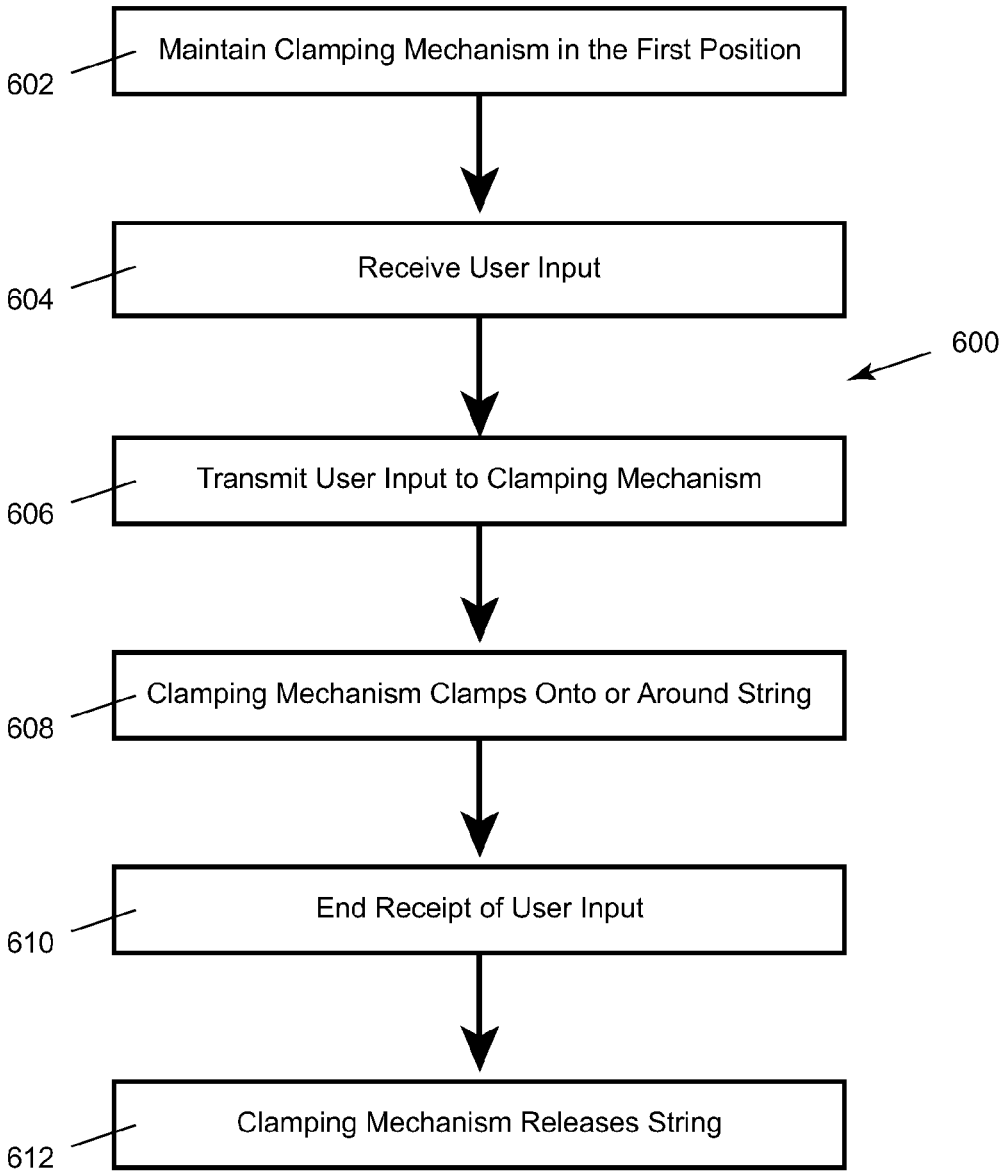
FIG. 6 is a flow-chart illustrating one method of using the musical instrument.

FIG. 5 depicts one embodiment of features configured to facilitate the routing of the transmission cable 182 from the control member 127 to the clamping mechanism 130. FIG. 5 depicts the portion of the musical instrument 100 comprising the neck 120 having a first side 126 and the control panel 125 having a top plate 174 including holes 180. The control panel 125 further includes a plurality of control members 127, each of which control members 127 is connected to a clamping mechanism 130 via a transmission cable 182. As seen in FIG. 6, the transmission cable 182 is routed from the control member 127 to the first actuation lever 152 of the first clamping member 132 of the clamping mechanism 130 over one or several cable routing rods 186 and via one or several cable routing posts.

The cable routing rod 186 can comprise a variety of shapes and sizes and can be made from a variety of materials. In some embodiments, the cable routing rod can comprise a bearing surface over which the transmission cable 182 can slide. In some embodiments, the cable routing rod 186 can comprise, for example, a variety of materials including, for example, a low friction material, a wear resistant material, and/or any other desired material.

In some embodiments, the cable routing rod 186 can be configured to minimize wear of the transmission cable 182 when the transmission cable 182 slides across the cable routing rod 186. In some embodiments, the cable routing rod 186 can comprise, for example, a natural material, a manmade material, metal, wood, polytetrafluoroethylene (PTFE), plastic, polymer, and/or any other desired material. In some embodiments, the cable routing rod 186 can be located on and/or affixed to the upper plate 174 of the control panel 125. In some embodiments, a single cable routing rod 186 can be configured to slidingly contact one or several transmission cables 182. In some embodiments, the cable routing rod 186 can comprise a circular cylindrical form. In some embodiments, in which the cable routing rod 186 comprises a circular cylindrical form, the transmission cable 182 can be configured to slide across the cable routing rod 186 perpendicular to the longitudinal access of the cable routing rod 186.

As depicted in FIG. 6, the transmission cable 182 can be routed between the control members 127 and the clamping mechanism 130 via a plurality of cable routing posts. As specifically depicted in FIG. 6, the transmission cable 182 is routed from the control member 127 to the clamping mechanism 130 via a first cable routing post 188, a second cable routing post 190, and a third cable routing post 192. The cable routing post 188, 190, 192 can be located in a variety of positions on the musical instrument 100 and can comprise a variety of shapes and sizes and can be made of a variety of materials. In some embodiments, the cable post 188, 190, 192 can comprise a manmade material, a natural material, a synthetic material, a composite material, metal, glass, wood, plastic, polytetrafluoroethylene (PTFE), polymer, and/or any other desired material. In some embodiments, the cable routing posts 188, 190, 192 can extend from the portion of the musical instrument 100 to which the cable routing post 188, 190, 192 is attached. In some embodiments, and as depicted in FIG. 6, the first cable routing post 188 can extend, for example, from the upper plate 174 of the control panel 125. In some embodiments, and as also depicted in FIG. 6, the second cable routing post 190 and the third cable routing post 192 can extend, for example, from the second side 128 of the neck 120.

The cable routing posts 188, 190, 192 can comprise a variety of shapes and sizes and can comprise, for example, a circular cylinder. In some embodiments, the cable routing post 188, 190, 192 can be sized and shaped to withstand the forces applied to them via the tensioning of the transmission cable 182 necessary to move the clamping mechanism 130 from a first position to a second position in which the clamping mechanism 130 clamps onto or around the string 110. In some embodiments, the positioning of the cable routing post 188, 190, 192 can be configured to allow the transmission cable 182 to move the clamping mechanism 130 in the desired direction.

A person of skill in the art will recognize that the transmission cable can be routed from the control member 127 to the clamping mechanism 130 using a variety of components, including one or several cable transmission rods 186 and one or several cable transmission posts 188, 190, 192 located in a variety of positions on the instrument 100. A person of skill in the art will further recognize that the transmission cable 182 can be routed from the control member 127 to the clamping mechanism using more or fewer components than those listed and recited above.

A person of skill in the art will further recognize that the musical instrument 100 can comprise more or fewer components than those listed and described above. A person of skill in the art will further recognize, that the components of the musical instrument 100 can comprise the same or different features than those listed and described above. A person of skill in the art will further recognize that the features of the musical instrument 100 can be configured to, and can have the same functions and/or different functions than those described above.

Methods of Clamping a String

In some embodiments, the musical instrument 100 can be used to clamp a string 110. FIG. 6 depicts one embodiment of a process 600 for clamping a string 110. In some embodiments, the process 600 begins at block 602 when the clamping mechanism is maintained in a first position. In some embodiments, the clamping mechanism, which can comprise, for example, the first clamping member 132 and the second clamping member 134, can be maintained in a first position via the expansion spring 166. In some embodiments, and referring specifically to FIG. 3, the expansion spring 166 can maintain the clamping mechanism 130 in the first position by applying a tensile force to the second actuation lever 162. In some embodiments, this force maintains the second clamping member 134 in an unclamped, open position. In some embodiments, this tensile force is transferred from the second clamping member 134 to the first clamping member 132 via the first camming surface 154 and the second camming surface 170. In some embodiments, this tensile force generated by the expansion spring 166 can be transmitted to the first clamping member 132 via the first camming surface 154 and the second camming surface 170, and this tensile force can be transmitted from the first clamping member 132 to the control member 127 via the transmission cable 182. In some embodiments, this tensile force which is transmitted to the control member 127 can maintain the control member 127 in a first position.

After the clamping mechanism 130 is maintained in a first position, the process 600 moves to block 604 and a user input is received at the control member 127. In some embodiments, the user input that is received at the control member 127 can move the control member 127 from a first position to a second position. In some embodiments, the user input can comprise a force sufficient to overcome the tensile force of the expansion spring 166 that is applied to the clamping mechanism 130.

After the user input is received at the control member 127, the process 600 moves to block 606 and the user input is transmitted to the clamping mechanism 130. In some embodiments, the user input can be transmitted to the clamping mechanism 130 via a variety of features, components, and/or systems. In some embodiments, and as discussed above, the user input can be transmitted to the clamping mechanism 130 via, for example, the transmission cable 182.

After the user input is transmitted to the clamping mechanism 130, the process 600 moves to block 608 and the clamping mechanism 130 clamps onto or around the string 110. In some embodiments, and as discussed above, the clamping mechanism 130, which can comprise, for example, a first clamping member 132 and a second clamping member 134 can clamp onto or around the string 110 by displacing the first clamping member 132 and/or the second clamping member 134 from a first position to a second position. In some embodiments, and as discussed above, the displacement of the first clamping member 132 and/or the second clamping member 134 from the first position to the second position can correspond, for example, to the displacement of the control member 127 from a first position to a second position.

After the clamping mechanism 130 clamps onto or around the string 110, the process 600 can move to block 610 and the user input can end. After the user input has ended as depicted in block 610, the process 600 can move to block 612 and the string 110 can be released by the clamping mechanism 130. In some embodiments, and as discussed above, the string 110 can be released via the tensile forces generated by the expansion spring 166 which bias the clamping mechanism 130 to a first, open position.

A person of skill in the art will recognize that the process 600 can comprise a variety of steps including those discussed above. A person of skill in the art will further recognize that the process 600 can include more or fewer steps than those listed above, and that the steps of the process 600 can be arranged in the same order as those discussed above or a different order than those discussed above. A person of skill in the art will also recognize that the process 600 can be performed once or several times in the operation of the musical instrument 100.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A musical instrument comprising:

a string comprising a first end and a second end, wherein the string is anchored at its first end and at its second end;

a plurality of clamping mechanisms positioned along the string between the first and second ends of the string, each clamping mechanism configured to clamp the string at a distinct location and comprising:

a first clamping member disposed on a first side of the string, the first clamping member comprising a first camming surface; and a second clamping member disposed on a second side of the string, the second side opposite the first side, the second clamping member comprising a second camming surface configured to interact with the first camming surface of the first clamping member to transfer force between the first clamping mechanism and the second clamping mechanism; and a control panel comprising a plurality of control members, each control member operably connected to a respective one of the plurality of clamping mechanisms, wherein each control member is independently operable to activate said respective one of the plurality of clamping mechanisms such that the first and second clamping members each move from a first position spaced apart from the string to a second position contacting the string so as to divide the string into a first portion and a second portion.

2. The musical instrument of claim 1, wherein the musical instrument further comprises a neck and a body.

3. The musical instrument of claim 2, wherein the first end of the string is anchored to the body of the musical instrument and the second end of the string is anchored to the neck of the musical instrument.

4. The musical instrument of claim 2, the body further comprising a pickup.

5. The musical instrument of claim 2, wherein the neck comprises a first side spaced apart from a second side, and wherein the string and the clamping mechanism are positioned between the first side and the second side.

6. The musical instrument of claim 1, wherein the first portion of the string is configured for vibration.

7. The musical instrument of claim 6, wherein the first portion of the string is configured for vibration over a pickup.

8. The musical instrument of claim 1, wherein the plurality of control members are positioned along a first section of the string, wherein the control panel extends along a second section of the string, and wherein a length of the second section of the string is shorter than a length of the first section of the string.

9. The musical instrument of claim 1, wherein, in the second position, the first and second clamping members contact the string without significantly altering the position of the contacted portion of the string.

10. An apparatus comprising:

a plurality of clamping mechanisms for use with a musical instrument, said musical instrument comprising a string, the plurality of clamping mechanisms configured to be positioned along the string of the musical instrument, each of the plurality of clamping mechanisms configured to clamp onto the string at a distinct location to thereby change frequency of the music generating portion of the string, and each of the plurality of clamping mechanisms comprising:

a first clamping member comprising:

a first clamping body; and a first camming surface; and a second clamping member comprising:

a second clamping body; and a second camming surface;

wherein the first camming surface of the first clamping member interacts with the second camming surface of the second clamping member, such that a movement of the first clamping member is transmitted to the second clamping member; and a control panel comprising a plurality of control members, each control member operably connected to a respective one of the plurality of clamping mechanisms, wherein each control member is independently operable to activate said respective one of the plurality of clamping mechanisms to cause said respective one of the plurality of clamping mechanisms to clamp onto the string;

wherein the control panel is spaced apart from the plurality of clamping mechanisms, and wherein each control member is connected to said respective one of the plurality of clamping mechanisms by a transmission member.

11. The apparatus of claim 10, wherein, for each of the plurality of clamping mechanisms, the first clamping member further comprises:

a first axle, wherein the first clamping member rotates about the first axle; and a first actuation lever.

12. The apparatus of claim 10, wherein, for each of the plurality of clamping mechanisms, the second clamping member further comprises:

a second axle, wherein the second clamping member rotates about the second axle; and a second actuation lever.

13. The apparatus of claim 12, wherein the second actuation lever is connected to an expansion spring.

14. The apparatus of claim 13, wherein the expansion spring comprises a linear spring or a rubber band.

15. The apparatus of claim 13, wherein the expansion spring biases the second clamping member to a first position.

16. The apparatus of claim 15, wherein the second clamping member does not contact the string when the second clamping member is in its first position.

17. The apparatus of claim 15, wherein the second clamping member biases the first clamping member to a first position when the second clamping member is in the first position.

18. The apparatus of claim 17, wherein the first clamping member does not contact the string when the first clamping member is in the first position, and wherein the second clamping does not contact the string when the second clamping member is in the first position.

19. The apparatus of claim 10, wherein the first or second clamping member comprises a clamping pad.

20. The clamping mechanism of claim 10, wherein when movement of said first clamping member is transmitted to said second clamping member, the first and second clamping members each move from a first position spaced apart from the string to a second position contacting the string so as to divide the string into a first portion and a second portion.

21. The clamping mechanism of claim 20, further comprising a control panel including a control member that is operably connected to the clamping mechanism, wherein said control member activates said clamping mechanism so as to divide the string into a first portion and a second portion.

22. The apparatus of claim 10, wherein one of said plurality of clamping mechanisms is positioned at a first position along the length of the string, and is operably connected to one of said plurality of control members, wherein said one of said plurality of control members is positioned at a second position along the length of the string, the first position different than the second position.

23. The apparatus of claim 10, wherein the transmission member comprises a tensile member.

24. A method of playing a musical instrument comprising a string having a first end and a second end, and a plurality of clamping mechanisms positioned along the string between the first and second ends, each clamping mechanism configured to clamp the string at a distinct location and comprising a first clamping member disposed on a first side of the string, the first clamping member comprising a first camming surface, and a second clamping member disposed on a second side of the string, the second side opposite the first side, the second clamping member comprising a second camming surface configured to interact with the first camming surface of the first clamping member, the plurality of clamping mechanisms comprising at least a first clamping mechanism configured to clamp the string at a first location, a second clamping mechanism configured to clamp the string at a second location distinct from the first location, the musical instrument further comprising a control panel comprising a plurality of control members, each control member operably connected to a respective one of the plurality of clamping mechanisms, wherein each control member is independently actuable to activate said respective one of the plurality of clamping mechanisms such that the first and second clamping members each move from a first position spaced apart from the string to a second position contacting the string, the plurality of control members comprising at least a first independently operable control member configured to control the operation of the first clamping mechanism and a second independently operable control member configured to control the operation of the second clamping mechanism, the method comprising:

vibrating the string;

actuating the first control member so that the first clamping mechanism clamps the string at the first location and thereby changes the natural frequency of the string; and actuating the second control member so that the second clamping mechanism clamps the string at the second location and thereby changes the natural frequency of the string.

25. The method of claim 24, wherein, in the second position, the first and second clamping members contact the string without significantly altering the position of the contacted portion of the string.

26. A device for clamping a string of a musical instrument comprising:

a plurality of clamping mechanisms each adapted to be positioned at a distinct location between the first and second ends of a string of said musical instrument, each clamping mechanism comprising:

a first clamping member adapted to be disposed on a first side of the string, the first clamping member comprising a first camming surface; and a second clamping member adapted to be disposed on a second side of the string, the second side opposite the first side, the second clamping member comprising a second camming surface configured to interact with the first camming surface of the first clamping member; and a control panel comprising a plurality of control members, each control member operably connected to a respective one of the plurality of clamping mechanisms, wherein each control member activates said respective one of the plurality of clamping mechanisms such that when said device is positioned on said musical instrument, actuation of said control members causes the first and second clamping members each to move from a first position spaced apart from the string to a second position contacting the string so as to divide the string into a first portion and a second portion.

27. The device of claim 26, wherein the control panel further comprises a plurality of control members operably connected to a plurality of clamping mechanisms, each clamping member being adapted to be positioned at a different position between the first end and the second end of the string.

28. The device of claim 26, wherein, in the second position, the first and second clamping members contact the string without significantly altering the position of the contacted portion of the string.

* * * * *